US008950821B2

(12) United States Patent
Fundakowski et al.

(10) Patent No.: US 8,950,821 B2
(45) Date of Patent: Feb. 10, 2015

(54) MILLING DRUM HAVING INTEGRAL TOOL MOUNTING BLOCKS

(75) Inventors: Anne K. Fundakowski, Roseville, MN (US); Benjamin T. Schafer, Elk River, MN (US); Joseph D. Koehler, Dayton, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/562,924

(22) Filed: Jul. 31, 2012

(65) Prior Publication Data

US 2014/0035346 A1 Feb. 6, 2014

(51) Int. Cl.
*E21C 35/19* (2006.01)
*E01C 23/088* (2006.01)

(52) U.S. Cl.
CPC ..... *E21C 35/19* (2013.01); *E01C 23/088* (2013.01); *E21C 2035/191* (2013.01)
USPC ..... 299/39.8; 299/87.1; 299/51

(58) Field of Classification Search
USPC ..... 299/39.4, 39.8, 51, 87.1, 102–113
See application file for complete search history.

(56) References Cited

U.S. PATENT DOCUMENTS

| | | | | |
|---|---|---|---|---|
| 2,414,559 | A | 1/1947 | Rochlus | |
| 3,866,769 | A | 2/1975 | Morey et al. | |
| 4,205,225 | A | 5/1980 | LeGoff | |
| 4,697,850 | A * | 10/1987 | Tuneblom | 299/87.1 |
| 5,052,757 | A * | 10/1991 | Latham | 299/87.1 |
| 5,106,166 | A * | 4/1992 | O'Neill | 299/104 |
| 5,904,408 | A * | 5/1999 | Olson et al. | 299/87.1 |
| 6,086,160 | A | 7/2000 | Bitelli | |
| 6,176,552 | B1 | 1/2001 | Topka, Jr. et al. | |
| 6,244,665 | B1 | 6/2001 | Bise et al. | |
| 6,779,850 | B1 * | 8/2004 | Schibeci et al. | 299/87.1 |
| 6,832,818 | B2 | 12/2004 | Luciano | |
| 7,338,134 | B2 | 3/2008 | Latham | |
| 7,357,608 | B2 | 4/2008 | Erickson et al. | |
| 7,380,887 | B2 * | 6/2008 | Latham | 299/87.1 |
| 7,520,570 | B2 | 4/2009 | Sansone et al. | |
| 7,547,074 | B2 | 6/2009 | Beach et al. | |
| 7,883,155 | B2 | 2/2011 | Sollami | |
| 2007/0056425 | A1 | 3/2007 | Bonar | |

(Continued)

FOREIGN PATENT DOCUMENTS

EP 771911 A1 * 5/1997

OTHER PUBLICATIONS

U.S. Patent Application by Anne K. Fundakowski et al., entitled "Milling Drum Tool Holder" filed on Jul. 31, 2012.
U.S. Design Patent Application by Anne K. Fundakowski et al., entitled "Bit Holder" filed on Jul. 31, 2012.

(Continued)

*Primary Examiner* — David Bagnell
*Assistant Examiner* — Michael Goodwin
(74) *Attorney, Agent, or Firm* — Finnegan, Henderson, Farabow, Garrett & Dunner LLP

(57) ABSTRACT

A tool mounting block is disclosed for use with a milling drum. The tool mounting block may have a flighting portion with a base surface configured to engage an outer cylindrical surface of the milling drum, and a mounting portion integrally formed with the flighting portion at a location opposite the base surface. The mounting portion may be configured to receive a separate tool holder. The tool mounting block may further have at least one locating feature integrally formed with the flighting and mounting portions. The at least one locating feature may be configured to interlock with at least one locating feature of an adjacent tool mounting block.

22 Claims, 7 Drawing Sheets

(56) References Cited

U.S. PATENT DOCUMENTS

| | | | | |
|---|---|---|---|---|
| 2008/0164749 | A1* | 7/2008 | Beach et al. | 299/106 |
| 2011/0163591 | A1 | 7/2011 | Sleep et al. | |

OTHER PUBLICATIONS

U.S. Design Patent Application by Anne K. Fundakowski et al., entitled "Mounting Block for Paving Apparatus" filed on Jul. 31, 2012.

* cited by examiner

MILLING DRUM HAVING INTEGRAL TOOL MOUNTING BLOCKS

RELATED APPLICATIONS

This application is based on and claims the benefit of priority from a design patent application entitled "BIT HOLDER" by Anne K. Fundakowski, Benjamin T. Schafer, and David N. Peterson that was filed on Jul. 31, 2012 under Ser. No. 29/428,495 the contents of which are expressly incorporated herein by reference.

This application is also based on and claims the benefit of priority from a design patent application entitled "MOUNTING BLOCK FOR PAVING APPARATUS" by Anne K. Fundakowski, Benjamin T. Schafer, and Joseph D. Koehler that was filed on Jul. 31, 2012 under the Ser. No. 29/428,508 the contents of which are expressly incorporated herein by reference.

TECHNICAL FIELD

The present disclosure relates generally to a milling drum and, more particularly, to a milling drum having integral tool mounting blocks.

BACKGROUND

Asphalt-surfaced roadways have been built to facilitate vehicular travel. Depending upon usage density, base conditions, temperature variation, moisture variation, and/or physical age, the surface of the roadways can eventually become misshapen, non-planar, unable to support wheel loads, or otherwise unsuitable for vehicular traffic. In order to rehabilitate the roadways for continued vehicular use, spent asphalt is removed in preparation for resurfacing.

Cold planers, sometimes also called road mills or scarifiers, are machines that typically include a frame quadrilaterally supported by tracked or wheeled drive units. The frame provides mounting for an engine, an operator's station, and a milling drum. The milling drum, fitted with cutting tools, is rotated through a suitable interface by the engine to break up the surface of the roadway.

In a typical configuration, multiple spiraling rows of cutting tools are oriented on an external surface of the milling drum to converge at a center of the drum. Each row of cutting tools includes a flighting and a plurality of cutting bits connected to the Righting by individual mounting blocks. In some configurations, the flighting is a continuous helical screw. In other configurations, the Righting is formed by individual segments of a helical screw, one segment for each mounting block. The flighting is welded to the external surface of the milling drum at a precise location and in a precise orientation, such that rotation of the milling drum results in desired movement of removed roadway material from the drum onto the center of a tandem conveyor. In addition, each mounting block is welded at a precise location and in a precise orientation onto a corresponding flighting such that the cutting bits are held in optimal positions that productively remove material while providing longevity to the tools. An exemplary milling drum is disclosed in U.S. Pat. No. 6,832,818 of Luciano that issued on Dec. 21, 2004.

Through use of the milling drum, the mounting blocks and/or flighting can be damaged. And due to the precision necessary in locating and orienting the flighting on the drum and the mounting blocks on the flighting, repairs to the milling drum are typically performed at the factory level or at specially equipped repair facilities by highly trained technicians. In some instances, robotic machinery is used to perform the repairs due to the precision required in locating and orienting the mounting blocks and/or flighting. Unfortunately, these requirements can result in high repair costs and cause the machine to be unavailable for use for an extended period of time.

The tool mounting block and milling drum of the present disclosure solve one or more of the problems set forth above and/or other problems in the art.

SUMMARY

In one aspect, the present disclosure relates to a tool mounting block for a milling drum. The tool mounting block may include a flighting portion having a base surface configured to engage an outer cylindrical surface of the milling drum, and a mounting portion integrally formed with the Righting portion at a location opposite the base surface. The mounting portion may be configured to receive a separate tool holder. The tool mounting block may further include at least one locating feature integrally formed with the flighting and mounting portions. The at least one locating feature may be configured to interlock with at least one locating feature of an adjacent tool mounting block.

In another aspect, the present disclosure may be related to another tool mounting block for a milling drum. This tool mounting block may include a flighting portion having a base surface configured to engage an outer cylindrical surface of the milling drum, and a mounting portion disposed opposite the base surface. The mounting portion may be configured to receive a separate tool holder. The tool mounting block may further include locating features positioned at opposing corners of the flighting portion and configured to interlock with locating features of adjacent tool mounting blocks to constrain the tool mounting block in at least two directions.

DETAILED DESCRIPTION

Figure 1:
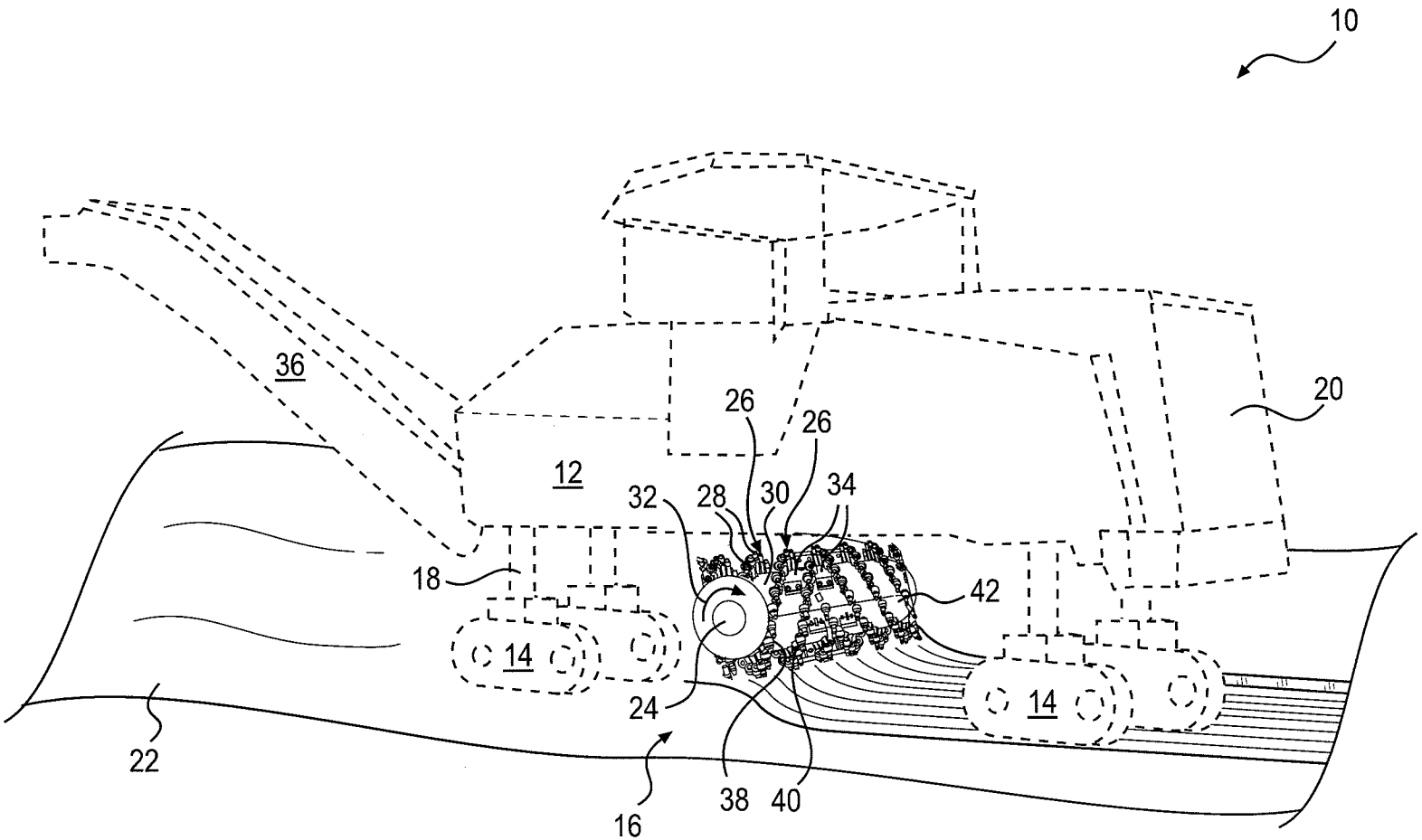
FIG. 1 is a pictorial illustration of an exemplary disclosed cold planer.

FIG. 1 illustrates an exemplary cold planer 10. Cold planer 10 may include a frame 12 connected to one or more traction units 14, and a milling drum 16 supported from frame 12 at a general center of cold planer 10 between traction units 14. Traction units 14 may each include either a wheel or a track section that is pivotally connected to frame 12 by a lifting column 18. Lifting columns 18 may be adapted to controllably raise, lower, and/or tilt frame 12 relative to the associated traction units 14. An engine 20 (or other power source) may be configured to electrically, mechanically, hydraulically, and/or pneumatically power traction units 14, milling drum 16, and lifting columns 18.

For the purpose of this disclosure, the term "asphalt" may be defined as a mixture of aggregate and asphalt cement. Asphalt cement may be a brownish-black solid or semi-solid mixture of bitumen obtained as a byproduct of petroleum distillation. The asphalt cement may be heated and mixed with the aggregate for use in paving roadway surfaces, where the mixture hardens upon cooling. A "cold planer" may be defined as a machine used to remove layers of hardened asphalt from an existing roadway. It is contemplated that the disclosed cold planer may also or alternatively be used to remove lime-based cement, concrete, and other roadway surfaces, if desired.

Milling drum 16 may include components rotated by engine 20 to fragment and remove chunks of asphalt and/or other material from a roadway surface 22. Specifically, milling drum 16 may include a rotary head 24 having one or more spiraling rows 26 of cutting tools 28 operatively connected to an outer cylindrical surface 30. In the disclosed embodiment, three spiraling rows 26 of cutting tools 28 initiate at each end of rotary head 24 and terminate at a lengthwise center of milling drum 16. It should be noted, however, that a greater or lesser number of rows 26 may be included, if desired. The spiraling configuration of rows 26 may function to migrate fragmented roadway material from the ends of rotary head 24 toward the center thereof as milling drum 16 is rotationally driven by engine 20 in the direction of an arrow 32. One or more paddles 34 may be located at the center of rotary head 24, between rows 26, to transfer the fragmented material onto a nearby conveyor 36.

Rows 26 may be arranged relative to the rotating direction of milling drum 16 such that one side of rows 26 is forced into engagement with the fragmented roadway material by the rotation. That is, each row 26 may have a material engaging first side 38 and a second side 40 that is located opposite from first side 38. Second side 40 may generally not engage the fragmented roadway material. A space 42 may be formed between first side 38 of a first row 26 and second side 40 of an adjacent second row 26. Space 42 may function as a channel for the fragmented material and have a size (e.g., a width) based on, among other things, an axial length of rotary head 24, a number of rows 26, and a spiral rate of rows 26. In general, although rows 26 may spiral along the length of rotary head 24, cutting tools 28 may generally point in a circumferential direction such that parallel surface grooves are created along a length of roadway surface 22. The parallel grooves created within roadway surface 22 may be generally aligned with a travel direction of cold planer 10. It is contemplated, however, that cutting tools 28 (and the resulting grooves in roadway surface 22) could be oriented differently, if desired.

Figure 2:
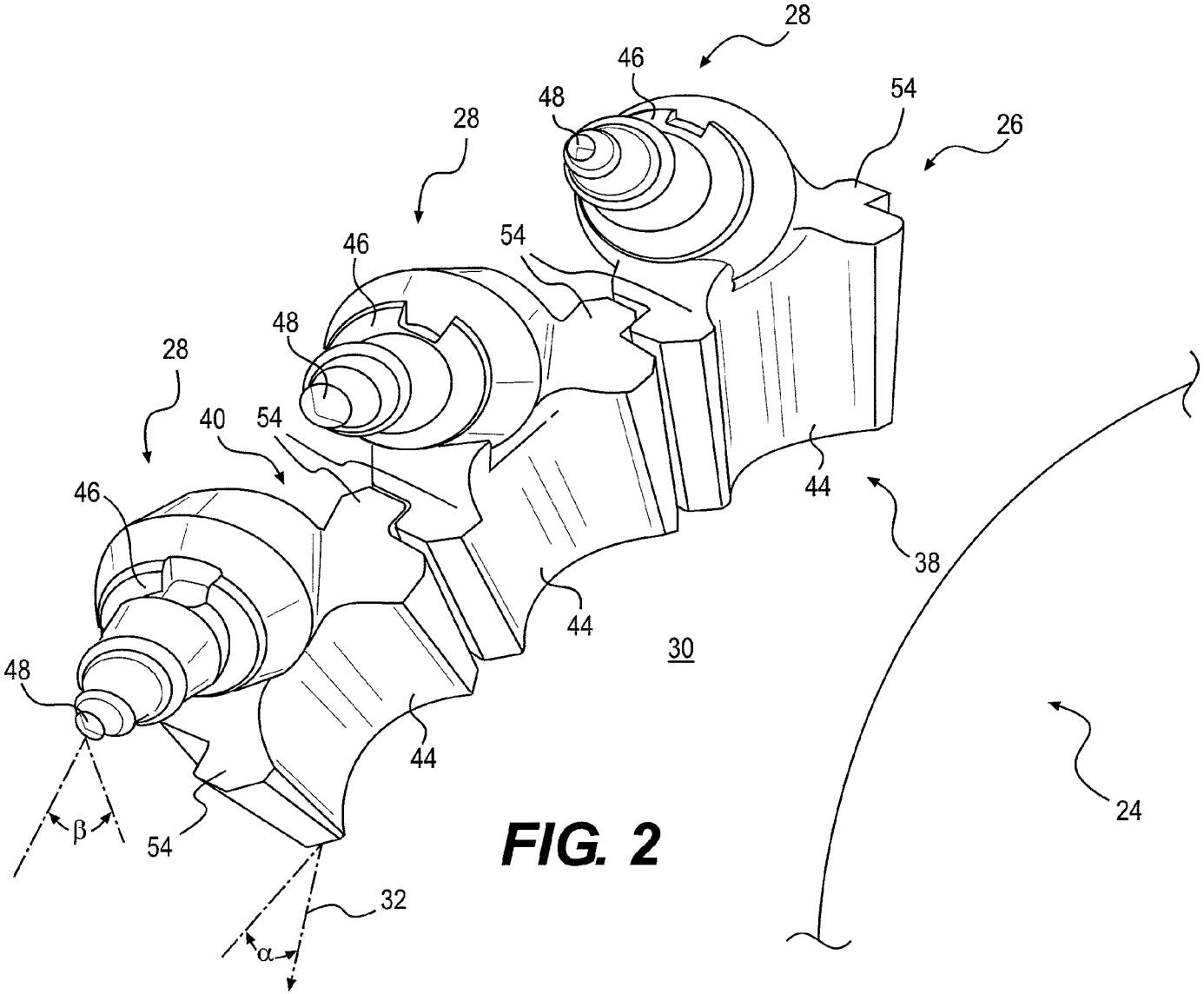
FIG. 2 is a pictorial illustration of exemplary disclosed cutting tools that may be used in conjunction with the cold planer of FIG. 1.
Figure 5:
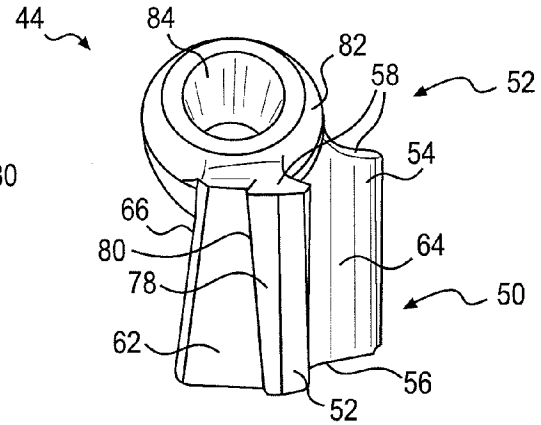
FIGS. 3-8 are pictorial illustrations of an exemplary disclosed tool mounting block that may be used in conjunction with the cutting tools of FIG. 2.
Figure 4:
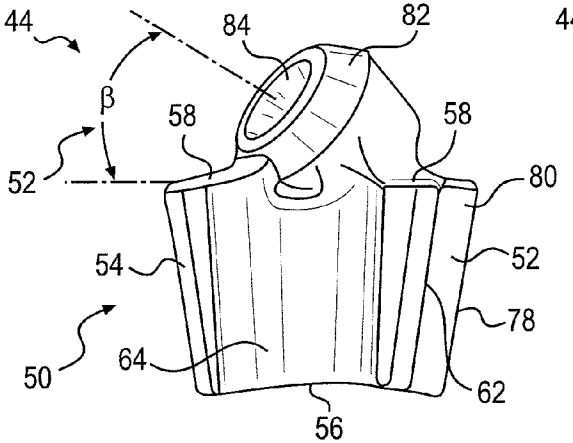

As shown in FIG. 2, each row 26 of cutting tools 28 may be formed by individual mounting blocks 44, tool holders 46, and cutting bits 48. Mounting blocks 44 may be fixedly connected to surface 30 of rotary head 24, for example by welding, and configured to removably receive tool holders 46. Each tool holder 46, in turn, may be configured to removably receive one cutting bit 48. The location and arrangement of mounting blocks 44 into rows 26, along with the location and orientation of tool holders 46 within mounting blocks 44, may have an effect on the removal efficiency, productivity, and resulting roadway surface quality produced by cutting bits 48. As will be explained in more detail below, individual mounting blocks 44 may be interlocked with adjacent (e.g., leading and trailing) mounting blocks 44 within the same spiraling row 26, such that the position and orientation of each mounting block 44 on rotary head 24 is determined by the interlocking.

As shown in FIGS. 3-8, each mounting block 44 may include a flighting portion 50, a mounting portion 52, and at least one locating feature 54. Flighting portion 50, mounting portion 52, and locating feature(s) 54 may be integrally formed as a single component. In the disclosed embodiment, mounting block 44 may be formed from a boron alloy through a forging process, although other materials and processes may alternatively be utilized, if desired. Mounting block 44 may have a hardness of about Rockwell 45-48 C.

Flighting portion 50 may be generally block-like and configured to engage outer surface 30 of rotary head 24 (referring to FIGS. 1 and 2). Flighting portion 50 may have a length direction, a width direction, and a height direction. The length direction of flighting portion 50 may generally align with the spiraling direction of rows 26, while the width direction may be generally transverse to the length direction. The height direction may be generally aligned with a radial direction of rotary head 24 and orthogonal to the length and width directions. Flighting portion 50 may include a base surface 56, an upper surface 58 located opposite base surface 56, a leading end surface 60, a trailing end surface 62 located opposite leading end surface 60, a first side surface 64, and a second side surface 66 located opposite first side surface 64. The length direction of flighting portion 50 may generally extend from leading end surface 60 toward trailing end surface 62. The width direction may generally extend from first side surface 64 toward second side surface 66. The height direction may generally extend from base surface 56 to upper surface 58. Leading end surface 60 may join first and second side surfaces 64, 66 at first and second leading corners 68, 70, respectively, while trailing end surface 62 may join first and second side surfaces 64, 66 at first and second trailing corners 72, 74, respectively.

Base surface 56 of each mounting block 44 may be curved in the length direction to generally match the curvature of rotary head 24. That is, base surface 56 may be curved from leading end surface 60 toward trailing end surface 62, and have an axis of curvature (not shown) that extends from first side surface 64 somewhat (e.g., at an oblique angle) toward second side surface 66. The radius of curvature of base surface 56 may generally match the radius of curvature of outer surface 30 of rotary head 24. Because of the spiraling nature of mounting blocks 44, the orientation of the axis of curvature of base surface 56 may be skewed somewhat relative to the length direction. For example, the axis of curvature may be skewed such that each mounting block 44 rests snuggly against outer surface 30 at its spiraled orientation. The angle of this skew will be discussed in more detail below. After assembly to rotary head 24, side edges of base surface 56 may be welded to outer surface 30.

Each mounting block 44 may be configured to engage adjacent mounting blocks 44 at leading and trailing end surfaces 60, 62. In particular, base surface 56 may have a length shorter than a length of upper surface 58, such that leading and trailing end surfaces 60, 62 taper inward from upper surface 58 to base surface 56 (shown in FIGS. 4 and 6). In this configuration, mounting blocks 44 may fit together like wedges in an arch around outer surface 30 of rotary head 24, each mounting block 44 supporting the adjacent mounting blocks 44 along the entire height of leading and trailing end surfaces 60, 62. After assembly, mounting blocks 44 may be welded to each other at upper transverse edges of leading and trailing end surfaces 60, 62. In some embodiments, mounting blocks 44 may also be welded to each other along a height of first and second, leading and trailing corners 68-74.

First side surfaces 64 of flighting portions 50 within adjacent mounting blocks 44 may together form first side 38 of rows 26. Due to the spiraling configuration of rows 26, first side surfaces 64 may be moved to engage fragmented roadway material within space 42 by the rotation of rotary head 24. As first side surfaces 64 engage the fragmented material, the material may deflect off first side surfaces 64 and be conveyed by the deflection toward a center of rotary head 24. That is, each first side surface 64, and in fact each flighting portion 50 of each mounting block 44 in general, may be angled relative to the rotational or circumferential direction of rotary head 24, and the angle may result in the desired deflection. In the disclosed embodiment, each flighting portion 50 may be oriented at an interior angle $\alpha$ of about 5-10° (shown in FIG. 2) relative to the rotational or circumferential direction of rotary head 24. In the disclosed embodiment, the skew of the curvature in base surface 56 (described above) may be about equal to the angle $\alpha$ (shown in FIG. 7), such that the curvature in base surface 56 matches the curvature of rotary head 24. First side surface 64 of each flighting portion 50, like base surface 56, may also be generally curved in the length direction (i.e., first side surface 64 may be concave). This concavity may help reduce an amount of material contained within mounting block 44 and, hence, a weight of each mounting block 44. It is contemplated, however, that first side surface 64 could have another contour (e.g., flat or convex), if desired.

Figure 3:
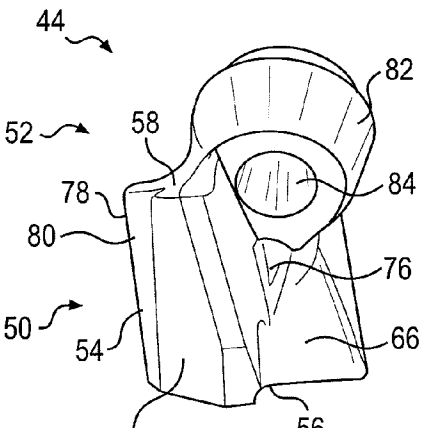
Figure 8:
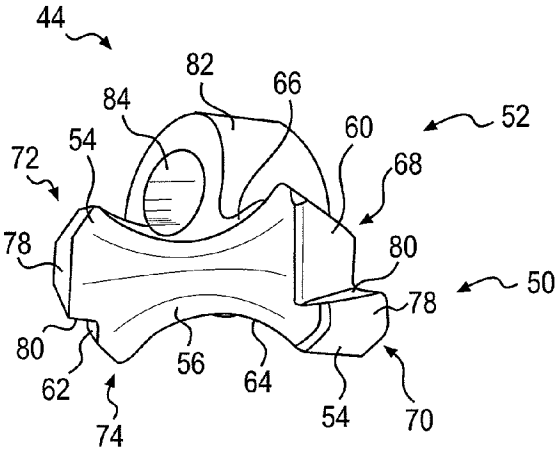
Figure 7:
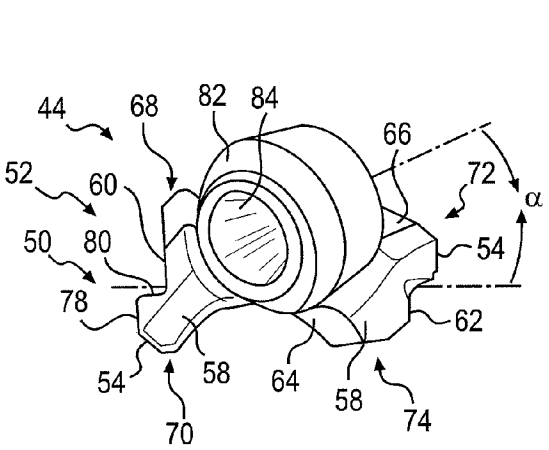
Figure 6:
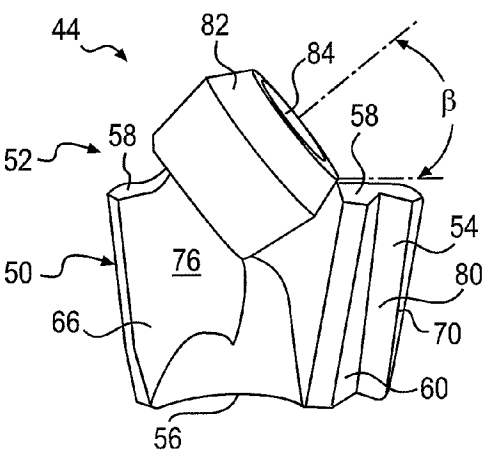
Figure 10:
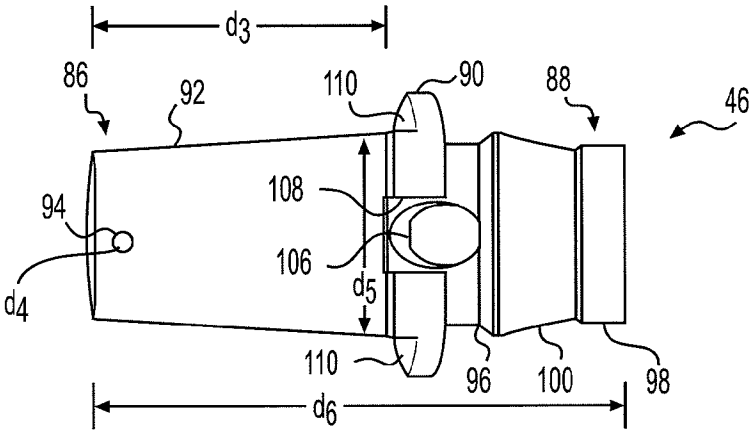
FIGS. 9-13 are pictorial and cross-sectional illustrations of an exemplary disclosed tool holder that may be used in conjunction with the cutting tools and the tool mounting blocks of FIGS. 2-8.
Figure 9:
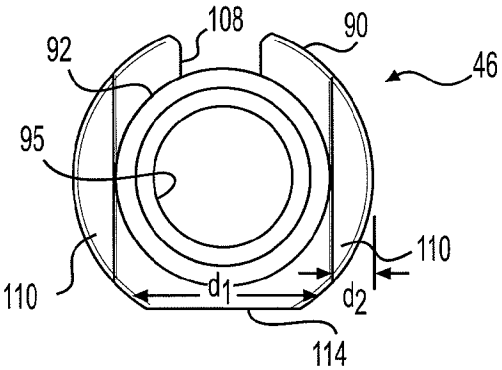
Figure 11:
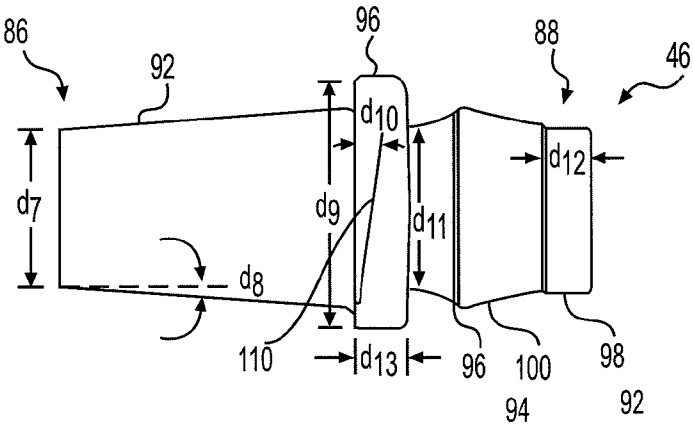
Figure 12:
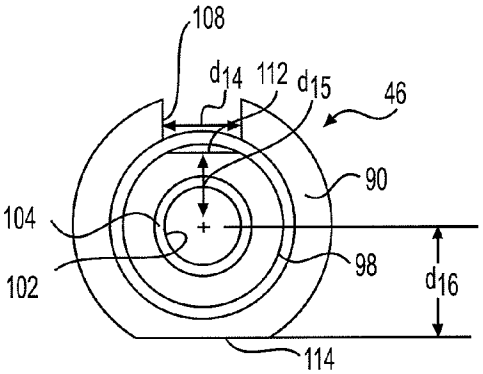
Figure 13:
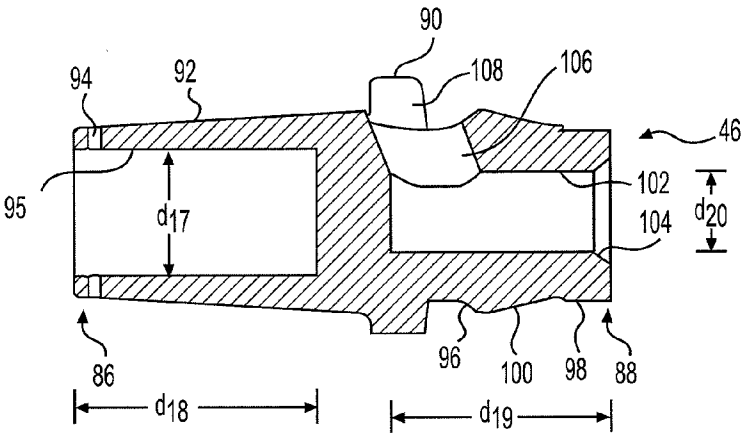

Second side 66 of each flighting portion 50 may include a recess 76 (shown in FIGS. 3 and 6). Recess 76 may be located at a lower or interior axial end of mounting portion 52. In this location, recess 76 may provide access to cutting bit 48 (referring to FIG. 2), allowing a service technician to pry or press against the end of a broken, damaged, or worn tool holder 46 to dislodge the tool holder 46 from mounting block 44. In general, second side surface 66 may not need to be as smooth or continuous as first side surface 64, as second side surface 66 may not typically function as a deflecting means for fragmented roadway material. That is, second side 66 may face away from the fragmented material and, accordingly, have any desired contour In the disclosed configuration, two locating features 54 are integrally formed with each mounting block 44. Locating features 54 may be oriented in a general zigzag configuration (see, for example, FIG. 2) at opposing corners of flighting portion 50 (e.g., at first leading corner 68 and second trailing corner 74 or at second leading corner 70 and first trailing corner 72) to engage the end surfaces (leading and trailing end surfaces 60, 62) and locating features 54 of adjacent mounting blocks 44. Specifically, each locating feature 54 may itself include an end surface 78, and an inward-facing side surface 80 that is generally orthogonal to end surface 78. Side surfaces 80 of the two locating features 54 of each mounting block 44 may generally face each other (i.e., face in opposing inward directions). End surfaces 78 of a first mounting block 44 may be configured to engage adjacent leading or trailing end surfaces 60, 62 of adjacent mounting blocks 44, while side surfaces 80 of adjacent mounting blocks 44 may engage each other. With this puzzle-like assembly, tool mounting blocks 44 may be interlocked and thereby constrained from movement in at least two directions (e.g., in a fore/aft direction and in a side-to-side direction). To remove one mounting block 44 from a particular row 26, after grinding or cutting away any associated welds, the particular mounting block 44 may either be lifted directly away from rotary head 24 in a radial direction or twisted (e.g., in a counterclockwise direction) relative to the adjacent mounting blocks 44 and then moved away. Installation of mounting block 44 may be accomplished in reverse manner, followed by welding of circumferential edges that are exposed.

Mounting portion 52 of mounting block 44 may be integrally formed with flighting portion 50 at a side opposite base surface 56 (i.e., at upper surface 58). Mounting portion 52 may be asymmetrically located relative to flighting portion 50, such that mounting portion 52 overhangs only one side of flighting portion 50. In particular, mounting portion 52 may overhang second side 66, away from a potential area of collision with fragmented roadway material at first side 68.

Mounting portion 52 may include a generally cylindrical body 82 having a central bore 84 fabricated therein. An axis of central bore 84 may be generally aligned with the rotational direction of rotary head 24 and, hence, skewed by about angle $\alpha$ relative to the length direction of flighting portion 50. In other words, central bore 84 may be oriented at an oblique angle relative to flighting portion 50, but generally aligned with the circumferential direction of rotary head 24. Central bore 84, as will be described in more detail below, may be configured to receive tool holder 46 (referring to FIG. 2) via a press-fit interference.

Central bore 84 of mounting portion 52 may also be oriented at an oblique attack angle $\beta$ relative to upper and/or base surfaces 56, 58 (e.g., relative to a tangent of outer surface 30 of rotary head 24 at a center of base surface 56). In this orientation, tool holder 46 and cutting bit 48 may be tilted away from rotary head 24 to engage roadway surface 22 in a desired manner. In the disclosed embodiment, attack angle $\beta$ may be an interior angle of about 35-45°.

As shown in FIGS. 9-13, tool holder 46 may be a generally hollow cylindrical member having a first end 86 and an opposing second end 88. First end 86 may be configured for insertion within central bore 84 of mounting portion 52, while second end 88 may be configured to receive cutting bit 48. A flange 90 may be located at a general mid-portion of tool holder 46, between first and second ends 86, 88. In the disclosed embodiment, flange 90 may be located closer to second end 88 than to first end 86, although other arrangements may also be possible. An outer surface 92 of tool holder 46 that extends from flange 90 to first end 86 may be tapered such that a diameter of outer surface 92 at first end 86 is less than an outer diameter at flange 90. In the disclosed embodiment, the outer diameter of surface 92 at flange 90 may be about 48-52 mm, and the taper of outer surface 92 may be about 3-5°. These dimensions may allow for a tight interference fit when tool holder 46 is pressed into mounting portion 52, while also providing shear strength to tool holder 46.

As tool holder 46 is pressed into central bore 84 of mounting portion 52, first end 86 may eventually protrude from the lower axial end of mounting portion 52 in the region of recess 76. In this state, a pin (e.g., a roll pin or a cotter pin—not shown) may be inserted through a cross-hole 94 and extend from opposing sides of outer surface 92 to inhibit separation or exiting of tool holder 46 from mounting portion 52. It should be noted that the pin may be intended primarily to inhibit separation during transport, as opposed to during operation.

First end 86 of tool holder 46 may include a blind bore 95 that stops axially short of flange 90. Blind bore 95 may function to reduce a weight of tool holder 46, while the material located axially between the end of blind bore 95 and flange 90 may enhance a strength of tool holder 46 at flange 90. In the disclosed embodiment, the end wall of blind bore 95 may be located a distance away from flange 90 that is about equal to one-half of the diameter of outer surface 92 at flange 90. It is contemplated, however, that blind bore 95 may end at another location, if desired. It is further contemplated that blind bore 95 may extend an entire length of tool holder 46, if desired.

Second end 88 of tool holder 46 may include a shoulder 96, a generally cylindrical tip end 98, and a tapered outer surface 100 extending between shoulder 96 and tip end 98. Shoulder 96 may mark the end of a "necked-down" area immediately adjacent flange 90. The necked-down area may have an outer diameter smaller than an outer diameter at an opposing side of flange 90 (i.e., smaller than an outer diameter of outer surface 92 at flange 90). This design may allow the necked-down area to function as a stress point intended to break just before breakage of flange 90 or the region between flange 90 and first end 86 can occur. If breakage of tool holder 46 were to occur within mounting portion 52 of mounting block 44, removal of the remaining broken stub of tool holder 46 could prove difficult. Outer surface 100 may function to displace fragmented material out past the periphery of flange 90 and mounting portion 52, thereby increasing the longevity of these components.

Second end 88 may also include a blind bore 102 that is generally aligned with blind bore 95 of first end 86. In the disclosed embodiment, blind bore 102 may extend to an axial location about midway through flange 90, although other depths of blind bore 102 may also be possible. Blind bore 102 may be configured to receive cutting bit 48, and have an internal chamfer 104 at an open end thereof to ease assembly of cutting bit 48 into tool holder 46. Blind bore 102 may have a diameter sized to receive cutting bit 48 via a press-fit interference. It should be noted that, in the disclosed embodiment, blind bore 102 does not communicate with blind bore 95 (i.e., tool holder 46 may does have a continuous axial opening). This configuration may increase a strength of tool holder 46 at flange 90. It is contemplated, however, that blind bore 102 could alternatively communicate with blind bore 95, if desired.

A radial opening 106 may pass through a side of tool holder 46 at flange 90 to intersect with a closed end of blind bore 102. Radial opening 106 may provide access to an internal end of cutting bit 48, such that cutting bit 48 may be pried out of tool holder 46 during servicing. In the disclosed embodiment, radial opening 106 may be inclined toward first end 86 to provide greater access and/or pry leverage. It is contemplated, however, that radial opening 106 could alternatively be oriented orthogonally relative to an axis of tool holder 46 or inclined toward second end 88, if desired. Flange 90 may be interrupted (e.g., include a recess 108) at opening 106 to provide clearance for a pry tool (not shown).

Flange 90 may include parallel sloped surfaces 110 (i.e., sloped relative to an axis of tool holder 46) at opposing sides thereof to facilitate removal of tool holder 46 from mounting block 44. Sloped surfaces 110 may be generally lengthwise-aligned with side walls of recess 108 in flange 90, and the area of flange 90 associated with sloped surfaces 110 may be thinnest at the side of tool holder 46 having opening 106. That is, sloped surfaces 110 may be formed within flange 90 and have a greatest depth at the side of tool holder 46 having opening 106. Sloped surfaces 110 may terminate at the mounting block-side of flange 90, and extend sideways and radially outward to a periphery of flange 90. A wedge shaped service tool (not shown) may be forced between tapered outer surfaces 100 and an external end of mounting portion 52 during servicing to force tool holder 46 out of bore 84.

Tool holder 46 may also include a void 112 formed at tip end 98 during fabrication thereof. Void 112 may embody, for example, a flat spot in the otherwise cylindrical outer surface of tip end 98, although void 112 may take other forms if desired. Void 112 may provide clearance to a shoulder of cutting bit 48 that protrudes past the edge of the flat spot. Using this clearance, a service technician may be able to apply force to the shoulder of cutting bit 48 to help remove cutting bit 48 from tool holder 46. For example, a service technician may be able to hammer against the shoulder of cutting bit 48 at void 112 to knock cutting bit 48 loose from tool holder 46.

An additional flattened area 114 may be formed within flange 90 at a side opposite recess 108, and used to ensure proper installation of tool holder 46. Specifically, flattened area 114 may provide clearance for a protruding portion of mounting block 44 (e.g., for upper surface 58) and, when tool holder 46 is turned to an incorrect angle, flange 90 may engage the protruding portion of mounting block 44 and inhibit insertion of tool holder 46 into bore 84 of mounting portion 52. When flattened area 114 is turned to face the protruding portion of mounting block 44, however, no interference may exist and tool holder 46 may slide into bore 84 in a relatively unobstructed manner. When tool holder 46 is assembled correctly within mounting portion 52 of mounting block 44, opening 106 may be exposed and accessible by a service technician. It is contemplated that flattened area 114 may alternatively or additionally be located at other areas of tool holder 46, if desired. For example, flattened area 114 may alternatively or additionally be formed within shoulder 96, if desired.

Cutting bit 48 may have a generally cylindrical body configured to be received within tool holder 46, and include a pointed hardened tip that engages roadway surface 22 during operation. In one example, the tip of cutting bit 48 may be fabricated from tungsten carbide, though other materials may also or alternatively be utilized. Although not shown, cutting bit 48 may also include a spring clip that surrounds the cylindrical body and functions to retain cutting bit 48 within tool holder 46, as is known in the art. In some embodiments, a washer may initially be located around the spring clip to hold the spring clip in a pre-loaded state, the washer then moving during assembly to an end of the spring clip to protect the corresponding tool holder 46 from relative movement of cutting bit 48.

The exemplary embodiment of tool holder 46 that is illustrated in FIGS. 9-13 is labeled with dimensions (d1-d20) corresponding to a particular design of tool holder 46 that has been shown to exhibit acceptable performance characteristics (e.g., durability, fit, strength, flexibility, etc.). Values for these dimensions are provided in the table below:

| Dimension | Value |
|---|---|
| d1 | 50 mm |
| d2 | 10 mm |
| d3 | 73.3 mm |
| d4 | 3 mm |
| d5 | 50 mm |
| d6 | 132.9 mm |
| d7 | 41.03 mm |
| d8 | 3.5 deg |
| d9 | 70 mm |
| d10 | 7.5 deg |
| d11 | 44 mm |
| d12 | 12 mm |
| d13 | 14.3 mm |
| d14 | 18.3 mm |
| d15 | 20 mm |
| d16 | 30 mm |
| d17 | 31 mm |
| d18 | 60 mm |

-continued

| Dimension | Value |
|---|---|
| d19 | 54 mm |
| d20 | 19.8 mm |

Figure 15:
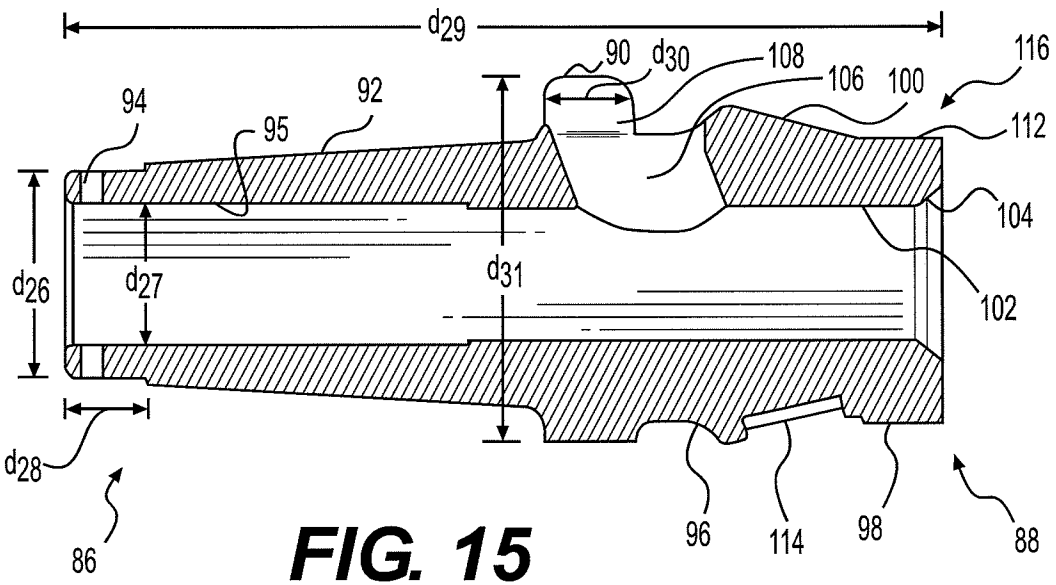
FIGS. 14-16 are pictorial and cross-sectional illustrations of another exemplary disclosed tool holder that may be used in conjunction with the cutting tools and the tool mounting blocks of FIGS. 2-8.
Figure 14:
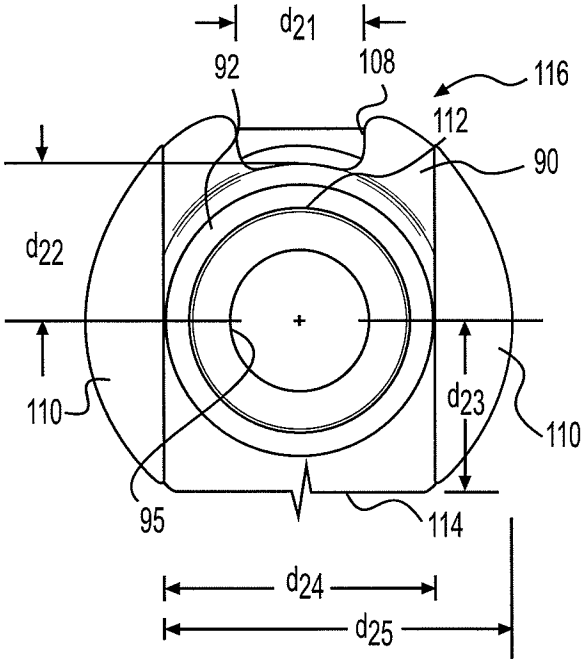
Figure 16:
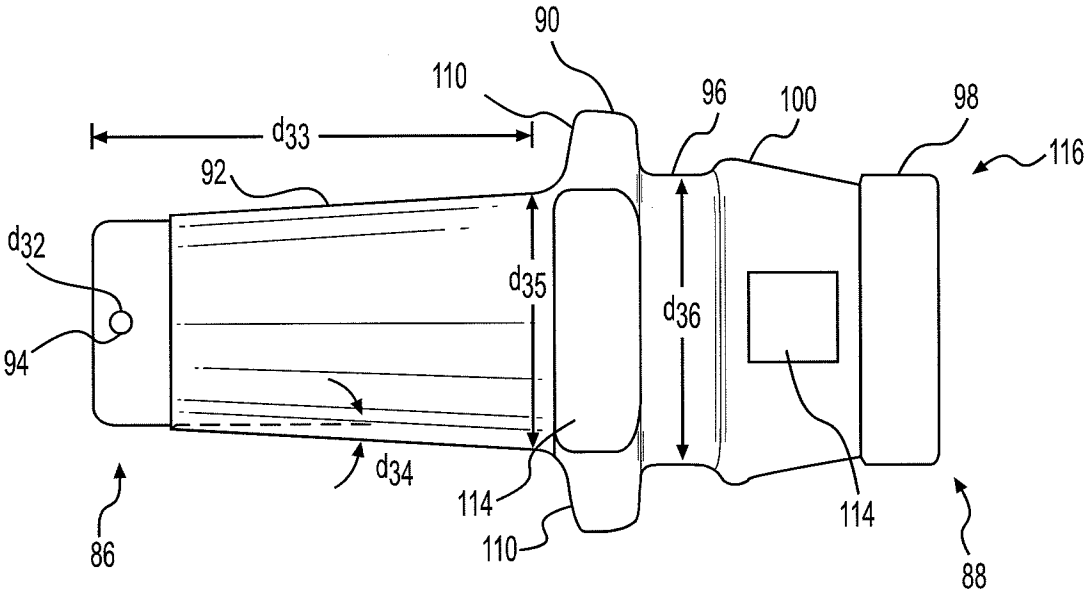

FIGS. 14-16 illustrate an alternative tool holder 116. Tool holder 116, like tool holder 46 may include cylindrical body 82 having first end 86, second end 88, and flange 90 located between first and second ends 86, 88. Tool holder 116 may also include outer surface 92, cross-hole 94, blind bore 95, shoulder 96, outer surface 100, blind bore 102, and chamfer 104. Tool holder 116 may likewise include radial opening 106, recess 108, sloped surfaces 110, and flattened area 114. However, in comparison to tool holder 46, outer surface 92 of tool holder 116 may have a smaller outer diameter at flange 90. In particular, the diameter of outer surface 92 at flange 90 of tool holder 116 may be the same or smaller than the outer diameter at the necked-down on the opposing side of flange 90. In addition, outer surface 92 at first end 86 may have a generally straight portion (i.e., outer surface 92 may not be tapered at first end 86) that facilitates machining of other features of tool holder 116 (e.g., blind bores 95 and 102). Finally, flattened area 114 of tool holder 116 may extend across both a portion of flange 90 (as with tool holder 46) and across a portion of shoulder 96. It is also contemplated that cross-hole 94 of tool holder 116 may have a larger diameter, if desired, to receive a larger size pin.

The exemplary embodiment of tool holder 116 that is illustrated in FIGS. 14-16 is labeled with dimensions (d21-d36) corresponding to a particular design of tool holder 46 that has been shown to exhibit acceptable performance characteristics (e.g., durability, fit, strength, flexibility, etc.). Values for these dimensions are provided in the table below:

| Dimension | Value |
|---|---|
| d21 | 18.3 mm |
| d22 | 20 mm |
| d23 | 25 mm |
| d24 | 41 mm |
| d25 | 52.5 mm |
| d26 | 31 mm |
| d27 | 21 mm |
| d28 | 12.3 deg |
| d29 | 131 mm |
| d30 | 13 mm |
| d31 | 64 mm |
| d32 | 3 mm |
| d33 | 71.4 mm |
| d34 | 3.5 deg |
| d35 | 39.66 mm |
| d36 | 44 mm |

Industrial Applicability

The disclosed tool mounting block and milling drum may be used within any cold planer for the fragmenting and removal of roadway surface material. The disclosed tool mounting block and milling drum may improve longevity of machine components and reduce component cost, while also decreasing servicing difficulty, time, and expense. Component longevity may be increased by consolidating previously-separated components into a single integral component having increased durability. In particular, by forging a single tool mounting block having both flighting and mounting portions, the durability of the single component may be greater than previously experienced by separate components. In addition, the single component reduces part count and associated servicing, thereby reducing a cost of the component. Finally, the interlocking nature of the disclosed tool mounting block may make it easier to replace damaged or broken components. That is, the locating and orienting of a replacement part may be made simpler through the interlocking interface with adjacent parts. This simplification may help to reduce repair cost and downtime of the cold planer. Replacement of damaged parts will now be described.

During operation of cold planer 10, it may be possible for cutting bit 48, tool holder 46 and/or mounting block 44 to be damaged or to break. Each of these components may be separately replaced or replaced together as an assembly. For example, to replace a damaged cutting bit 48, a pry tool may be inserted through opening 106 (referring to FIGS. 10 and 13), and pressed against the internal end of cutting bit 48. Pressure may then be applied to the pry tool in the direction of first end 86, thereby forcing cutting bit 48 out of blind bore 102. Additionally or alternatively, a mallet may be struck against the shoulder of cutting bit 48 in the direction of second end 88, thereby knocking cutting bit 48 out of blind bore 102. A new cutting bit 48 may then be pressed back into blind bore 102, until the washer of cutting bit 48 engages second end 88 of tool holder 46.

Tool holder 46 may be replaced in similar manner. In particular, a pry tool may be inserted between flange 90 and mounting portion 52 of mounting block 44, at sloped surfaces 110. The pry tool may be hammered into this space, thereby creating a force normal to sloped surfaces 110 that urges tool holder 46 out of bore 84 of mounting block 44. Additionally or alternatively, a mallet may be struck against first end 86 of tool holder 46 that protrudes from mounting portion 52 until tool holder 46 is knocked free of mounting block 44. A new tool holder 46 may then be pressed into bore 84 of mounting portion 52.

To remove a damaged mounting block 44 from milling drum 16, welds holding mounting block 44 in place against surface 30 of rotary head 24 may first be ground or cut away. These welds may include arcuate welds located between the side edges of base surface 56 and surface 30, and vertical welds located between the side edges of leading and trailing end surfaces 60, 62 of adjacent mounting blocks 44 (i.e. at each opposing end of the damaged mounting block 44). The welds may further include transverse welds located across the upper edges of leading and trailing end surfaces 60, 62. After these welds have been ground or cut away, the damaged mounting block 44 may either be lifted directly away from rotary head 24 in a radial direction or twisted in a counter-clockwise direction and then moved away.

To install a new mounting block 44, the new mounting block 44 may be inserted radially back into the space vacated by the damaged mounting block 44, or inserted between the existing adjacent mounting blocks 44 and then twisted in a clockwise direction until locating features 54 of the new tool mounting block 44 interlock with locating features 54 of the existing mounting blocks 44. Welding may then commence around the exposed periphery of the new mounting block 44.

It will be apparent to those skilled in the art that various modifications and variations can be made to the disclosed tool mounting block and milling drum without departing from the scope of the disclosure. Other embodiments of the tool mounting block and milling drum will be apparent to those skilled in the art from consideration of the specification and practice of the tool mounting block and milling drum disclosed herein. It is intended that the specification and examples be considered as exemplary only, with a true scope of the disclosure being indicated by the following claims and their equivalents.

What is claimed is:

1. A tool mounting block for a milling drum, the tool mounting block comprising:

a flighting portion having a base surface configured to engage an outer cylindrical surface of the milling drum;

a mounting portion integrally formed with the flighting portion at a location opposite the base surface and configured to receive a separate tool holder;

a first locating feature extending away from the base surface along the flighting portion and being integrally formed with the flighting and mounting portions; and a second locating feature extending away from the base surface along the flighting portion and being integrally formed with the flighting and mounting portions, wherein the first locating feature is configured to interlock with a corresponding second locating feature of an adjacent tool mounting block and inhibit lateral movement of the tool mounting block on the milling drum in at least a length direction and a width direction, the length direction and the width direction being orthogonal to a height direction that is generally aligned with a radial direction of the milling drum.

2. The tool mounting block of claim 1, wherein the flighting portion, the mounting portion, the first locating feature, and the second locating feature are integrally formed through a forging process.

3. The tool mounting block of claim 1, wherein:

the tool holder is generally cylindrical;

the mounting portion includes a bore configured to receive the tool holder; and the bore is oriented at a first oblique angle relative to the base surface of the flighting portion and at a second oblique angle relative to a rotational direction of the milling drum.

4. The tool mounting block of claim 3, further including a recess formed in a side surface of the flighting portion at an end of the bore in the mounting portion, the recess being configured to provide access to an end of the tool holder.

5. The tool mounting block of claim 4, wherein the flighting portion includes a material conveying side surface located opposite the recess.

6. The tool mounting block of claim 3, wherein the base surface of the flighting portion has a curvature in a lengthwise direction that substantially matches a curvature of the outer cylindrical surface of the milling drum.

7. The tool mounting block of claim 1, wherein:

the flighting portion includes an upper surface located opposite from the base surface; and the upper surface has a greater length than the base surface such that the flighting portion is tapered inward from the upper surface toward the base surface in a lengthwise direction.

8. The tool mounting block of claim 1, wherein:

the flighting portion includes a material conveying side surface and an opposing side surface; and the mounting portion overhangs the flighting portion at only the opposing side surface.

9. A tool mounting block for a milling drum, the tool mounting block comprising:

a flighting portion having a base surface configured to engage an outer cylindrical surface of the milling drum;

a mounting portion integrally formed with the flighting portion at a location opposite the base surface and configured to receive a separate tool holder, the tool being generally cylindrical, the mounting portion including a bore configured to receive the tool holder, the bore oriented at an oblique angle relative to the base surface of the flighting portion;

at least one locating feature integrally formed with the fighting and mounting portions and configured to interlock with at least one locating feature of an adjacent tool mounting block; and a recess formed in a side surface of the flighting portion at an end of the bore in the mounting portion, the recess being configured to provide access to an end of the tool holder;

wherein the flighting portion includes a material conveying side surface located opposite the recess and curved in a lengthwise direction of the flighting portion.

10. A tool mounting block for a milling drum, the tool mounting block comprising:

a fighting portion having a base surface configured to engage an outer cylindrical surface of the milling drum;

a mounting portion integrally formed with the flighting portion at a location opposite the base surface and configured to receive a separate tool holder;

a first locating feature extending away from the base surface along the fighting portion and being integrally formed with the fighting and mounting portions; and a second locating feature extending away from the base surface along the fighting portion and being integrally formed with the flighting and mounting portions, wherein:

the first locating feature is configured to interlock with a corresponding second locating feature of an adjacent tool mounting block;

the first locating feature is formed at a corner of the flighting portion and includes an end surface, and a side surface that is oriented about 90 ° relative to the end surface and relative to the outer cylindrical surface of the milling drum;

the end surface is configured to engage a corresponding end surface of the fighting portion of the adjacent tool mounting block to constrain the tool mounting block in a first direction; and the side surface is configured to engage a corresponding side surface of the adjacent tool mounting block to constrain the tool mounting block in a second direction.

11. The tool mounting block of claim 10, wherein the first locating feature and the second locating feature are disposed at opposing corners of the flighting portion.

12. The tool mounting block of claim 11, wherein the side surface of the first locating feature and the side surface of the second locating feature are oriented in opposition to each.

13. A tool mounting block for a milling drum, the tool mounting block comprising:

a flighting portion having a base surface configured to engage an outer cylindrical surface of the milling drum;

a mounting portion disposed opposite the base surface and configured to receive a separate tool holder; and locating features extending away from the base surface along the flighting portion, positioned at opposing corners of the flighting portion, and configured to interlock with corresponding locating features of adjacent tool mounting blocks to constrain the tool mounting block in a length direction and a width direction, the length direction and the width direction being orthogonal to a height direction that is generally aligned with a radial direction of the milling drum.

14. The tool mounting block of claim 13, wherein:

the tool holder is generally cylindrical;

the mounting portion includes a bore configured to receive the tool holder; and the bore is oriented at a first oblique angle relative to the base surface of the fighting portion and at a second oblique angle relative to a rotational direction of the milling drum.

15. The tool mounting block of claim 14, further including a recess formed in a side surface of the flighting portion at an end of the bore in the mounting portion, the recess configured to provide access to an end of the tool holder.

16. The tool mounting block of claim 13, wherein:

the flighting portion includes an upper surface located opposite from the base surface; and the upper surface has a greater length than the base surface such that the flighting portion is tapered inward from the upper surface toward the base surface in a lengthwise direction,

17. The tool mounting block of claim 13, wherein:

the fighting portion includes a material conveying side surface and an opposing side surface; and the mounting portion overhangs the flighting portion at only the opposing side surface.

18. A tool mounting block for a milling drum, the tool mounting block comprising:

a flighting portion having a base surface configured to engage an outer cylindrical surface of the milling drum;

a mounting portion disposed opposite the base surface and configured to receive a separate tool holder, the tool holder being generally cylindrical, the mountinq portion including a bore configured to receive the tool holder, the bore being oriented at an oblique angle relative to the base surface of the flighting portion;

locating features positioned at opposing corners of the flighting portion and configured to interlock with locating features of adjacent tool mounting blocks to constrain the tool mounting block in at least two directions;

a recess formed in a side surface of the flighting portion at an end of the bore in the mounting portion, the recess being configured to provide access to an end of the tool holder, wherein the flighting portion includes a material conveying side surface located opposite the recess and curved in a lengthwise direction of the fighting portion.

19. The tool mounting block of claim 18, wherein the base surface of the fighting portion has a curvature in a lengthwise direction that substantially matches a curvature of the outer cylindrical surface of the milling drum.

20. A tool mounting block for a milling drum, the tool mounting block comprising:

a fighting portion having a base surface configured to engage an outer cylindrical surface of the milling drum;

a mounting portion disposed opposite the base surface and configured to receive a separate tool holder; and locating features extending away from the base surface along the fighting portion, positioned at opposing corners of the fighting portion, and configured to interlock with locating features of an adjacent tool mounting block;

wherein:

each of the locating features includes an end surface and a side surface;

the end surface is configured to engage a corresponding end surface of the fighting portion of the adjacent tool mounting block to constrain the tool mounting block in a length direction;

the side surface is configured to engage a corresponding side surface of the locating feature of the adjacent tool mounting block to constrain the tool mounting block in a width direction, the side surface facing the with direction; and the length direction and the width direction are orthoqonal to a height direction that is generally aligned with a radial direction of the milling drum.

21. A milling drum, comprising:

a head having a cylindrical outer surface;

a plurality of mounting blocks arranged into spiraling rows on the cylindrical outer surface of the head, each of the plurality of mounting blocks including:

a flighting portion welded to the cylindrical outer surface, the flighting portion including a base surface configured to engage the cylindrical outer surface and an upper surface opposite the base surface, a mounting portion integrally formed on the upper surface of the flighting portion, and two locating features extending away from the base surface and integrally formed at opposing corners of the flighting portion;

a plurality of cutting bits; and a plurality of tool holders operatively connecting the plurality of cutting bits to the plurality of mounting blocks, wherein the two locating features of adjacent ones of the plurality of mounting blocks within the same spiraling row abut each other to thereby locate and orient each in a length direction generally aligned with a spiraling direction of the respective row and in a width direction generally transverse to the length direction, the length direction and the width direction being orthogonal to a height direction that is generally aligned with a radial direction of the head.

22. The milling drum of claim 21, wherein each of the plurality of mounting blocks is welded to the cylindrical outer surface of the head at lower side edges of the flighting portion and welded to the adjacent ones of the plurality of mounting blocks at upper end edges.

* * * * *